US011143088B2

(12) United States Patent
Dumas

(10) Patent No.: US 11,143,088 B2
(45) Date of Patent: Oct. 12, 2021

(54) MULTI-COMPARTMENT LIQUID RESERVOIR FOR A MOTOR VEHICLE

(71) Applicant: ILLINOIS TOOL WORKS INC., Glenview, IL (US)

(72) Inventor: Pascal Dumas, Cluny (FR)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 16/771,328

(22) PCT Filed: Dec. 11, 2018

(86) PCT No.: PCT/US2018/064823
§ 371 (c)(1),
(2) Date: Jun. 10, 2020

(87) PCT Pub. No.: WO2019/118385
PCT Pub. Date: Jun. 20, 2019

(65) Prior Publication Data

US 2020/0340389 A1 Oct. 29, 2020

(30) Foreign Application Priority Data

Dec. 13, 2017 (FR) ..... 1762020

(51) Int. Cl.
*F01P 11/02* (2006.01)
*F01P 7/16* (2006.01)
*F01P 7/14* (2006.01)

(52) U.S. Cl.
CPC ..... *F01P 11/029* (2013.01); *F01P 7/165* (2013.01); *F01P 11/0238* (2013.01);
(Continued)

(58) Field of Classification Search
CPC ..... F01P 11/029; F01P 7/165; F01P 11/0238; F01P 2007/146; F01P 2025/08; F01P 2050/24; F01P 11/02
See application file for complete search history.

(56) References Cited

U.S. PATENT DOCUMENTS

2015/0345368 A1* 12/2015 Le Poul ..... B65D 41/04 123/41.51

FOREIGN PATENT DOCUMENTS

DE 102017004632 A1 11/2017
GB 2525415 A 10/2015
(Continued)

OTHER PUBLICATIONS

PCT, International Search Report and Written Opinion, International Application No. PCT/US2018/064823; dated Feb. 4, 2019, 10 pages.

*Primary Examiner* — Jacob M Amick
(74) *Attorney, Agent, or Firm* — Thompson Hine LLP

(57) ABSTRACT

Multi-compartment liquid reservoir (10), for a motor vehicle, including a first fluid compartment (14) equipped with a fluid inlet (18) and with a fluid outlet (22), and a second fluid compartment (16) equipped with a fluid inlet (20) and with a fluid outlet (24), the reservoir including a liquid-filling neck (12) and the compartments in fluid communication via at least one passage (30) allowing one of the compartments to be filled via the other of the compartments, the reservoir further including at least one shut-off system (44), able to move between a first position of opening of the at least one passage and a position of closure of the at least one passage, wherein the shut-off system is configured to adopt the first position by default and in the free state, and to be urged into the second position when the reservoir is in operation.

15 Claims, 3 Drawing Sheets

(52) U.S. Cl.
CPC ..... *F01P 2007/146* (2013.01); *F01P 2025/08* (2013.01); *F01P 2050/24* (2013.01)

(56) References Cited

FOREIGN PATENT DOCUMENTS

| | | | |
|---|---|---|---|
| WO | WO 2010059106 | A1 | 5/2010 |
| WO | WO 2014111640 | A1 | 7/2014 |

* cited by examiner

MULTI-COMPARTMENT LIQUID RESERVOIR FOR A MOTOR VEHICLE

TECHNICAL FIELD

The present invention relates to a multi-compartment liquid reservoir for a motor vehicle.

BACKGROUND

A liquid reservoir having compartments is connected to, at least, two different liquid circuits of a cooling system of a motor vehicle combustion engine/electric motor.

A reservoir of this type has several functions for each of the liquid circuits: expansion, venting, compensating for possible micro-leak losses, filling and levelling, etc. To provide these functions, the reservoir comprises a first main compartment used for the first circuit and an additional compartment used for each of the other circuits. The compartments contain the same type of fluid but which is at different temperatures during operation due to the specific characteristics of each of the circuits using the liquid. The reservoir can be designed such that the compartments can be filled by a single filling neck and such that the compartments do not communicate with one another and are isolated from one another when the vehicle operates.

The application WO-A1-2014111640 describes a reservoir of this type in which the communication between the two compartments can only occur when the plug for closing the neck is unscrewed and removed, i.e. when the reservoir is being filled.

The present invention proposes an improvement to this technology, which is simple, effective, and makes it possible to reduce the volume of the additional compartments of the reservoir, which is necessary for proper operation.

DISCLOSURE OF THE INVENTION

To this end, the invention proposes a multi-compartment liquid reservoir, particularly for a motor vehicle, comprising a first fluid compartment equipped with a fluid inlet and with a fluid outlet, and a second fluid compartment equipped with a fluid inlet and with a fluid outlet, said reservoir comprising a liquid-filling neck and said compartments being in fluid communication via at least one passage allowing one of the compartments to be filled via the other of the compartments, said reservoir further comprising at least one shut-off system, able to move between a first position of opening of said at least one passage and a position of closure of said at least one passage, characterized in that said shut-off system is configured to adopt said first position by default and in the free state, and to be urged into said second position when the reservoir is in operation namely when a fluid is circulating in at least one of said compartments from its inlet as far as its outlet or when an operating temperature of the fluid is reached.

In the present application, "in the free state" means that the shut-off system is not urged into a particular position by an outer element, such as due to the fact that it is in contact with a fluid or submerged in a fluid. Even if it is in contact with such a liquid, the latter has no influence on the position of the shut-off system which is "in the free state". It adopts a rest or equilibrium position independently of any event or outer element.

"By default" means an operating condition of the reservoir, i.e. that the reservoir is ready to be used, and is, for example, plugged (neck shut off), wherein fluids can circulate through the inlets and outlets of the compartments, or these fluids even being already present in these compartments.

The reservoir is thus designed such that, when the vehicle has stopped or when the reservoir is not used and no fluid circulates in at least one of the compartments thereof, the or each passage for communication between the compartments is open. Therefore, the compartments communicate with one another and this allows for simultaneous filling and automatic equalization of the liquid levels in the compartments when the reservoir is not in operation.

In operation, the liquid which circulates in at least one of the compartments causes the shutter to move as far as the position thereof for closing the passage, thus isolating the compartments from one another. The respective liquids thereof can therefore be brought to different temperatures without the risk of mixing while the reservoir operates. At the end of an operating cycle and when the liquid will no longer circulate in the compartment, the shutter will again adopt the opening position thereof which will lead to the renewed automatic equalization of the liquid levels. The operation of the shut-off system is therefore of the "autonomous" type since it does not require intervention or external control.

The shut-off system can comprise a simple shutter that can move due to the circulation of the fluid, which thus applies a force sufficient for moving the shutter between the positions thereof. As an alternative or as an additional feature, the shut-off system can comprise a thermostatic element (wax, shape memory wire, etc.). The shutter can thus be moved by the temperature and/or the flow of the liquid, etc. When the shutter is actuated by the temperature, the shutter will be configured to adopt the first position when the temperature of the liquid and therefore the temperature of the shutter or of the thermostatic element thereof will be below a threshold value, and to adopt the second position when the temperature of the liquid and therefore the temperature of the shutter or of the thermostatic element thereof will be above this threshold value, which is a value dependent upon the operating temperature of the liquid.

The reservoir according to the invention can comprise one or more of the following features, taken separately from one another or in combination with one another:

- the reservoir comprises other compartments,
- said shut-off system comprises at least one shutter,
- said shutter is able to move by pivoting or linearly between said positions,
- said shut-off system or said shutter is situated inside said second compartment,
- said shutter has an elongated shape and is pivotably mounted about an axis substantially perpendicular to an elongation axis of the shutter,
- said shutter comprises two blocks at the two longitudinal ends thereof, a first block being configured to cooperate with said fluid to make the shutter adopt said second position, and a second shut-off block being configured to create or obstruct the passage of the fluid between the two compartments,
- said shutter adopts said first position as a result of gravity,
  - said second block is configured to shut off a fluid inlet of said second compartment, this inlet including a duct which passes through said first compartment as far as the upper end of the latter,
  - said second block has a bulged surface intended to engage an annular seat of complimentary shape of said passage,
- said blocks have different masses, said second compartment comprises limit stops defining said first and second positions, said second compartment is situated inside a parallelepipedal external volume defined by said first compartment, said second compartment is situated below a minimum level for liquid in said first compartment, said second compartment is separated from said first compartment by at least one insulating space and/or by at least one insulating plate, said insulating space is a peripheral insulating space extending over at least one side of said second compartment, said insulating plate comprises either a static air layer or a structure making it possible to limit the velocity of the fluid at its surface, such as honeycomb cells, said compartments communicate with one another by means of at least one venting and expansion tube, a lower end of which is connected to said first compartment and an upper end of which is situated in the second compartment and above a maximum level for liquid in said first compartment, said plate bears said at least one venting tube, said first and second compartments form a one-piece assembly, said shut-off system comprises at least one thermostatic element, said shut-off system is configured to adopt said first position by default and in the free state, i.e. when the reservoir is in a condition of use when the engine/motor has stopped.

BRIEF DESCRIPTION OF THE FIGURES

The invention will be better understood and other details, features and advantages of the invention will emerge more clearly upon reading the following description given by way of nonlimiting example and with reference to the appended drawings wherein.

DETAILED DESCRIPTION

Figure 1:
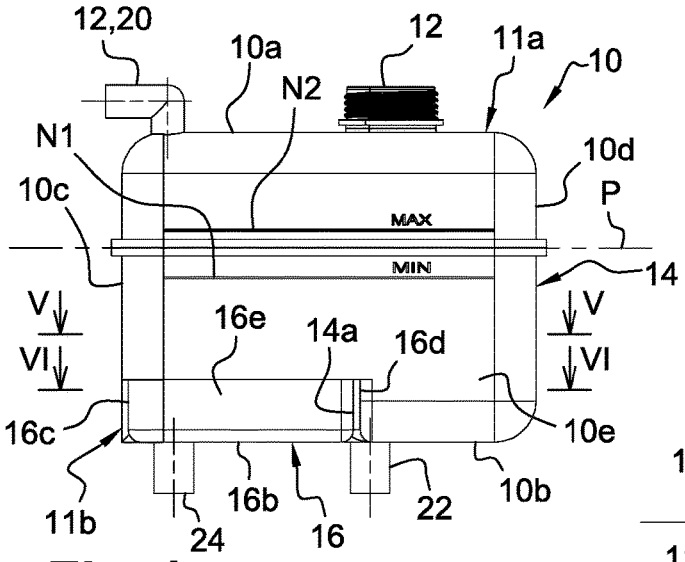
FIG. 1 is a schematic side view of a liquid reservoir according to the invention.

FIGS. 1 to 8 show an embodiment of a reservoir 10 having multiple, and in this case two, compartments according to the invention, which is able to be used in a cooling circuit of a motor vehicle.

The reservoir 10 comprises a filling neck 12 and two compartments 14, 16 each equipped with an inlet 18, 20 and an outlet 22, 24.

In the example shown, the reservoir 10 has a generally parallelepipedal shape and comprises an upper face 10*a* in this case including the filling neck 12, a lower face 10*b*, front 10*c* and rear 10*d* faces situated on the left and on the right in the drawing, respectively, and two lateral faces 10*e* extending between the front and rear faces.

Conventionally, the neck 12 has an external threading for screwing on a plug (not shown) for sealed closure of the reservoir 10.

The inlets 18, 20 of the compartments 14, 16 are in this case situated on the upper face 10*a* and the outlets 22, 24 thereof are situated on the lower face 10*b*. These inlets and outlets are formed by ducts.

Figure 3:
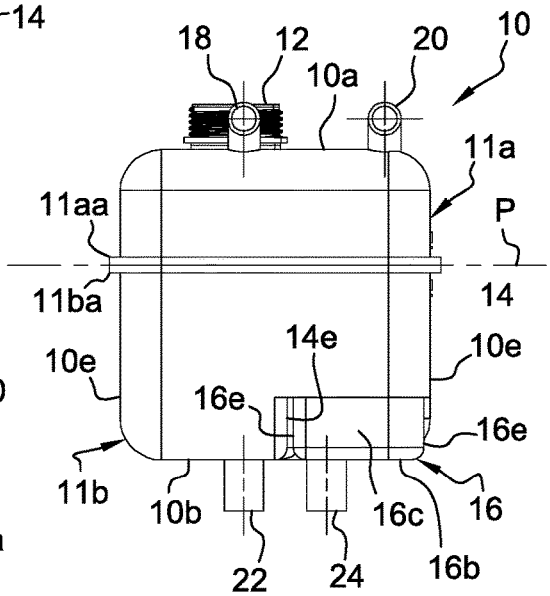
FIGS. 2 to 4 are schematic views, top, front and bottom, respectively, of the reservoir of FIG. 1, FIGS. 5 and 6 are sectional schematic views along the lines V-V and VI-VI of FIG. 1.
Figure 2:
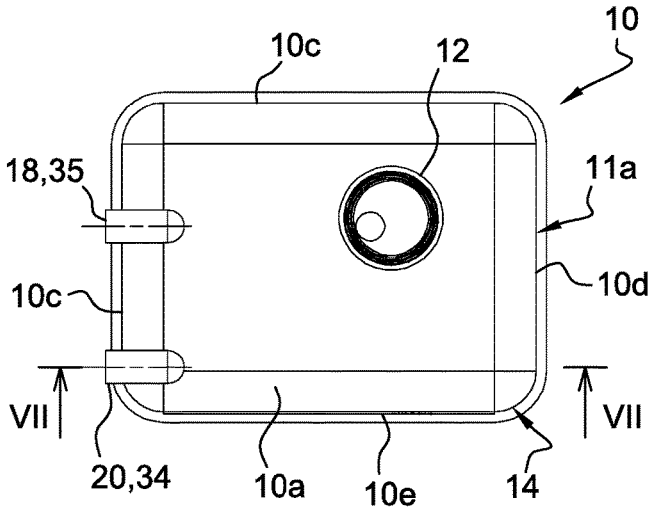

The reservoir 10 can be made from plastic. As can be seen in FIGS. 1 and 3 in particular, the reservoir 10 can be produced by assembling two shells, upper 11*a* and lower 11*b*, respectively. The shells 11*a*, 11*b* are manufactured independently of one another, for example by injection molding and are fixed to one another by welding or sticking in a substantially horizontal joint plane P. The lower shell 11*b* comprises, at the joint plane P, a peripheral rim 11*ba* for fixing to a peripheral rim 11*aa* of the upper shell 11*a*.

The inlets 18, 20 are rigidly connected to and preferably formed as a single piece with the upper shell 11*a*. The outlets 22, 24 are rigidly connected to and preferably formed as a single piece with the lower shell 11*b*.

The second compartment 16 is preferably situated at a lower end of the first compartment 14, as in the example shown. Moreover, the second compartment 16 preferably has an internal volume V2 that is less than that V1 of the first compartment 14. In the example shown, V2 represents less than 15% of V1.

Figure 4:
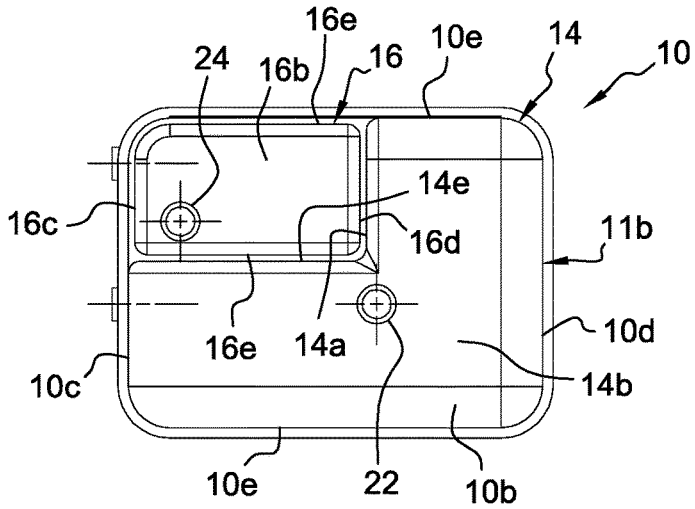

FIGS. 1, 3 and 4 make it possible to appreciate the shape and the position of the second compartment 16. This second compartment 16 in this case has a generally parallelepipedal shape, the lower face 16*b* of which is merged or aligned with the lower face 10*b* of the reservoir 10. The compartment 16 further has the front face 16*c* thereof and a lateral face 16*e* which are merged or aligned with the face 10*c* and a face 10*e*, respectively, of the reservoir. The second compartment 16 has a length, a width and a height which are less than those of the reservoir, such that the upper 16*a* and rear 16*d* faces thereof and the other lateral face 16*e* are situated inside the parallelepipedal external volume defined by the reservoir.

The first compartment 14 on the whole comprises the rest of the volume of the reservoir 10 which is not occupied by the second compartment 16. In other words, the volume thereof is broken down into a substantially parallelepipedal upper portion, situated above the compartment 16, and an L-shaped portion (cf. FIG. 4) extending around this compartment 16.

The outlet 24 of the second compartment is situated on the lower face 16*b* and the outlet 22 of the first compartment is situated on the L-shaped lower face 14*b* of this compartment.

As is seen in particular in FIGS. 1, 3 and 4, the rear 16*d* and lateral 16*e* faces of the compartment 16 are at a distance from front 14*c* and lateral 14*e* faces with regard to the compartment 14, such that the compartments 14, 16 are separated from one another by a thermal insulation air peripheral space.

FIGS. 5 to 8 make it possible to see the inside of the reservoir 10. The second compartment 16 has the upper face thereof which is defined by a plate 26 added in the lower shell 11*b* (welded, clipped, etc.). This plate 26 has a honeycomb structure and comprises a substantially planar lower face and an upper face which is covered with honeycomb cells 27. Advantageously, the lower face of the plate is inclined or truncated, as will be seen hereafter. The aim of the honeycomb structure is to thermally insulate the upper face of the compartment 16. In operation, liquid is contained in these cells and does not circulate. Therefore, it stagnates upon contact with the plate, and this makes it possible to limit the heat exchanges through the plate 26.

Figure 5:
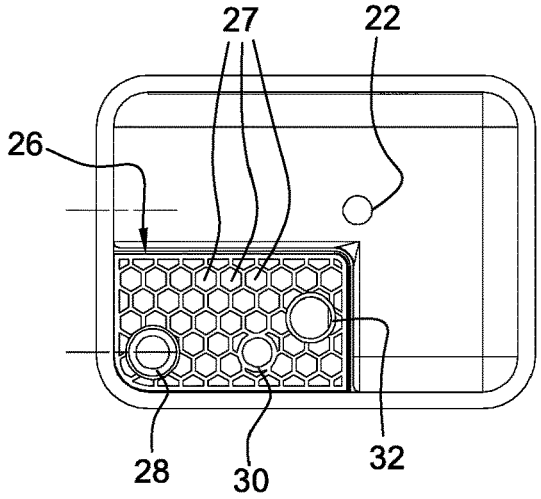

As is seen in FIG. 5, this plate 26 comprises three holes 28, 30 and 32. The hole 28 is connected to a lower end of the duct 34 forming the inlet 20 of the second compartment 16. This duct 34 vertically passes through the first compartment 14. The lower end thereof connected to the hole 28 is vertically orientated and the upper end thereof is bent and orientated in the forward direction after having passed through the upper face 10*a* of the reservoir 10.

Although not visible, the duct 35 which forms the inlet of the compartment 14 is similar to the duct 34 and comprises a lower end leading into the compartment 14 and an upper end bent and orientated in the forward direction after having passed through the upper face 10*a* of the reservoir 10.

Figure 7:
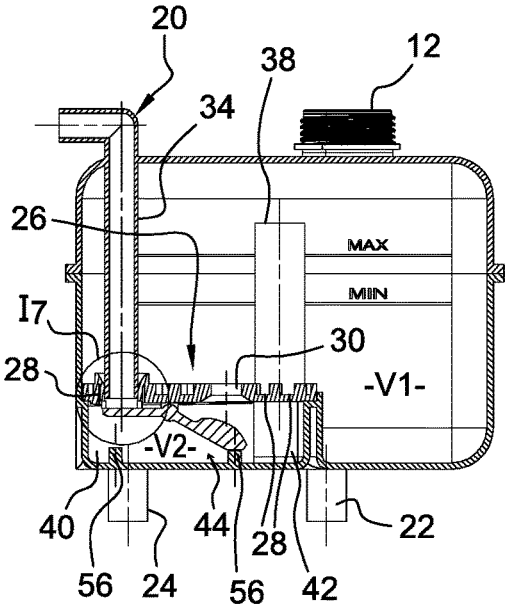
FIG. 7 is a sectional schematic view along the line VII-VII of FIG. 2, and illustrates a shut-off system having a rotating shutter in a first position.
Figure 7A:
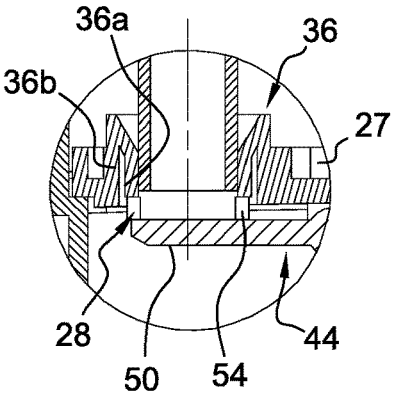
FIG. 7*a* is an enlarged view of the detail I7 of FIG. 7.

As is seen in FIG. 7*a*, the plate 26 can comprise on the upper face thereof a guiding bush 36 defining the hole 28 and facilitating the blind insertion of the lower end of the duct 34 when assembling the shells 11*a*, 11*b*. This bush 36 comprises, for example, an internal bore including a truncated upper portion widened in the upward direction and a cylindrical lower portion, the diameter of which is a function of the external diameter of the duct 34 in order to allow it to be fitted into the bush. This also makes it possible to provide a seal between the two compartments 14 and 16.

The bush 36 can be of the type having a double coaxial cylindrical wall, the internal cylindrical wall 36*a* mounted around the duct 34 being movable in the radial direction by elastic deformation with respect to the external cylindrical wall 36*b*, in order to further facilitate the aforementioned blind mounting.

The hole 30 forms a passage for fluid communication between the compartments 14, 16. It preferably has a cylindrical upper portion and a lower portion widened in the downward direction with a generally truncated shape or being hemispherical (FIG. 7).

The hole 32 is connected to a lower end of a venting and expansion tube 38 which is substantially vertical and extends into the first compartment 14. The upper end of the tube 38 is situated in the first compartment 14, above the maximum level N2 for liquid of the first compartment 14 and of the reservoir in general. This level N2 is produced by a protruding mark formed on the outside of the reservoir, for example on one of the lateral faces 10*e* thereof (cf. FIG. 1). The reservoir 10 also comprises a minimum level N1 for liquid which is produced by another protruding mark formed on the outside of the reservoir (cf. FIG. 1).

The venting tube 38 has, for example, a generally cylindrical shape. Advantageously, the internal volume of the tube 38 situated between the plate 26 and the level N2 is greater than the internal volume of the duct 34. This can be characterized by a tube 38 with a diameter greater than that of the duct 34, as in the example shown.

Figure 6:
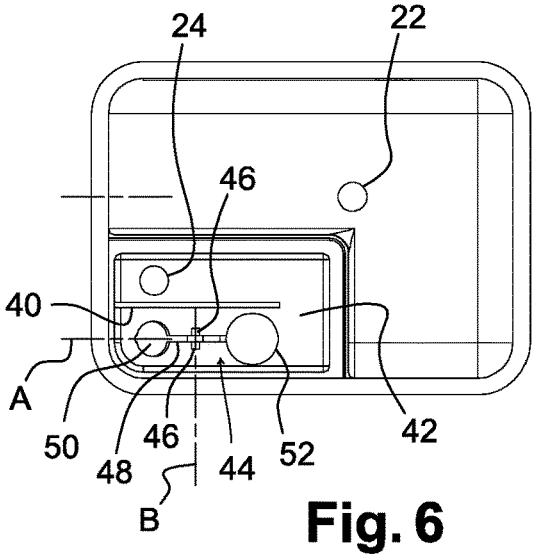

As is seen in FIGS. 5 and 6, the holes 28 and 30 are substantially aligned on a same line parallel to the lateral faces 10*e*, 16*e* of the compartment 16 or of the reservoir 10. The holes 28, 30 are situated in proximity to the merged lateral faces 10*e*, 16*e* and lead into a lateral half-portion of the compartment 16, which lateral half-portion is situated on the side of these lateral faces. This half-portion is separated from the other lateral half-portion of the compartment 16 by an internal partition 40 extending over most of the length of the compartment 16. The partition 40 is connected to the upper, lower and front ends of the compartment and is at a distance from the rear end thereof such as to leave an opening 42 for communication between the two half-portions of the compartment 16. The outlet 24 of the compartment 16 is connected to the other half-portion (cf. FIG. 6), thus creating a circulation flow from the hole 28 to the outlet 24 inside the compartment 16.

The hole 32 of the venting tube 38 is situated at the opening 42 (FIGS. 5 and 7). The plate 26 can be slightly inclined such that the gases, which are lighter than the liquid, are forced to circulate as far as the venting tube. Advantageously, the lower face of the plate 26 is truncated, with the summit forming the highest point and is situated at the hole 32 for communication with the tube 38, in order to facilitate the venting of the compartment 16.

The reservoir 10 further comprises a shut-off system having a shutter 44 that is able to move, and more precisely pivoting. It is situated in the compartment 16 and pivotably mounted between two positions, a first position shown in FIG. 7 in which the hole 30 or the passage for fluid communication between the compartments 14, 16 is free, i.e. open, and a second position, respectively, shown in FIG. 8 in which this hole is closed and therefore the compartments 14, 16 are isolated from one another.

The shutter 44 has a generally elongated shape and has an elongation axis A. It is movably mounted around a transverse axis B, substantially perpendicular to the axis A and situated substantially midway between the longitudinal ends thereof.

The shutter 44 can be formed as a single piece. The pivoting axis B can be defined by two cylindrical pins 46 extending on either side of a body 48 of the shutter 44 (FIG. 6). The pins 46 are, for example, engaged by elastic snap-fitting into recesses, of complimentary shape, of the plate 26. The plate 26 thus comprises means (not visible) for supporting and pivoting the shutter 44, in this case on the lower face thereof.

At each of the longitudinal ends thereof, the body of the shutter 44 bears a block 50, 52. A first block 50 has a generally circular or cylindrical shape and is intended to engage the hole 28. In the position shown in FIG. 7, the periphery of the block bears on an internal peripheral edge of the hole 28, or a lower peripheral edge of the internal cylindrical wall 36*a* of the bush 36, as can be seen in FIG. 7*a*. This internal peripheral edge preferably comprises radial notches 54 to allow through air and/or liquid here when the reservoir is being filled.

Figure 8:
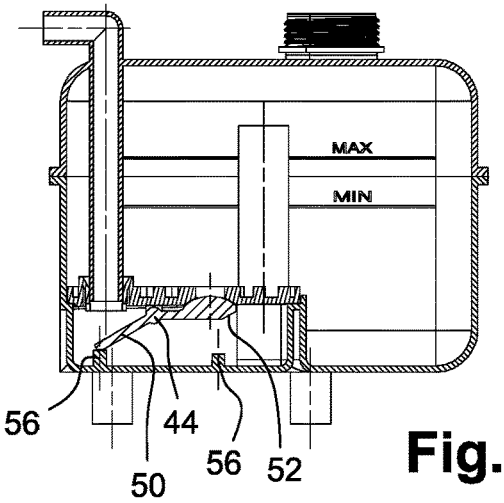
FIG. 8 is a view corresponding to FIG. 7, and illustrates the shutter in a second position.

The second block 52 has a generally circular shape and has, in section, a convex rounded shape at the upper end thereof, which is intended to engage the seat, of complimentary shape, formed by the lower portion of the hole 30. In the position of FIG. 8, the periphery of the block bears on the seat of the hole 30 in order to provide a sealed contact.

As seen in FIGS. 7 and 8, limit stops 56 are provided in the second compartment 16 in order to engage the blocks 50, 52 of the shutter and define the travel end positions thereof. The limit stops 56 project from the lower face of the compartment, substantially in line with the holes 28, 30, respectively.

In the example shown, the reservoir 10 is formed from the shells 11*a*, 11*b* forming, after assembly, a one-piece assembly, from the plate 26, from the venting tube 38 and from the shutter 44. The shutter 44 and the plate 26 can be firstly assembled, then the plate is assembled by clipping, welding, etc., in the shell 11*b*, the venting tube 38 is mounted on the plate 26, and the shell 11*a* is fixed to the shell 11*b*.

The filling neck 12 or the plug thereof is advantageously equipped with a valve preventing an excess pressure in the reservoir 10.

The operation of the reservoir 10 according to the invention is as follows:

Filling Phase without Prior Evacuation (After-sales service)

The two compartments are filled via the neck 12, up to the maximum level N2. Given that the engine/motor has stopped, the shutter 44, under the weight thereof, adopts the position of FIG. 7 (or possibly assisted by an elastic element, of spring type—not shown) in which it leaves the hole 30 open. By means of simple gravity, due to the fact of the block 52 thereof being overdimensioned with respect to the block 50, the block 52 bears on the limit stop 56. The communication between the two compartments 14 and 16 is therefore possible. However, the two ducts 34 and 35, extending the inlets 20 and 18, respectively, do not fill up since no venting system is provided.

First Start-Up/Stop After Filling

Upon first start-up, the air contained in the duct 35 will be pushed by the liquid inside the compartment 14 above the maximum level N2 of the reservoir 10. Upon stopping, the duct 35 will not empty since the end thereof is completely submerged below the minimum level N1 of the reservoir 10.

Upon first start-up, the air contained in the duct 34 will be pushed by the liquid inside the compartment 16. If the liquid flow rate is sufficiently weak such as to not allow the shutter 44 to shut off the hole 30, the air expelled in this manner will move above the level N2 via the hole 30. If the liquid flow rate is strong, the shutter 44 will then be moved up to the position of FIG. 8 in which it will shut off the hole 30. The liquids exerts a force on the block 50 which will come to bear on the limit stop 56. The air expelled in this manner will move above the maximum level N2 via the tube 38, the end of which is the high point of the compartment 16. The liquid contained in this tube 38 before start-up will then be incorporated into the compartment 16. Given that the volume of the tube 38 is greater than the volume of the duct 34, the liquid level at the end of venting will be above the plate 26, making it possible to have a compartment 16 without air. During the temperature increase of the second circuit, the liquid will expand via the tube 38. If, however, the liquid were to overflow into the compartment 14, it would be reincorporated upon stopping as described hereafter. Upon stopping, the duct 34 will not empty since the end thereof is completely submerged below the minimum level N1 of the reservoir 10. The shutter 44, under the weight thereof, or assisted by an elastic element that is not shown, will tilt in order to open the hole 30 and will make communication possible between the two compartments 14, 16: the liquid having possibly overflowed via the tube 38 upon the temperature increase of the second circuit will then be reincorporated while accompanying the fall in temperature of the second circuit. Given that the compartment 16 is situated below the minimum level N1 of the reservoir 10, it will remain full of liquid without air.

Subsequent Start-Up Operations

With the two circuits having been purged of air upon first start-up, the compartment 14 will behave like a conventional venting reservoir and the compartment 16 will behave like an expansion capacity for the second circuit (via the tube 38 and the volume above the level N2 of the reservoir 10). The two circuits will be separated by the shutter 44 which will tilt as soon as the flow rate of the liquid of the second circuit will be sufficient.

Sensitivity to the Traffic Conditions (Instance of Acceleration, Breaking and Bends)

The compartment 14 is designed in a conventional manner such that the liquid permanently covers the outlet 22 regardless of the traffic conditions.

The compartment 16 does not contain air and the communication between the two compartments is sealed, and the compartment is therefore unaffected by the traffic conditions even if the plate 26 were to be no longer submerged, partially or completely, on the compartment 14 side.

In the example described above, the reservoir only comprises two compartments. However, it could comprise three or more thereof, each additional compartment substantially having the same features of the second compartment described above.

The operation of the reservoir 10 would be similar in the case where the shutter would be replaced by another shut-off system of the linear shutter (ball, etc.) or thermostatic element (wax, shape memory wire, etc.) type and for which the shut-off would only take place during the operation of the engine/motor.

FIGS. 9 to 12 show alternative embodiments of the shut-off system.

Figure 9:
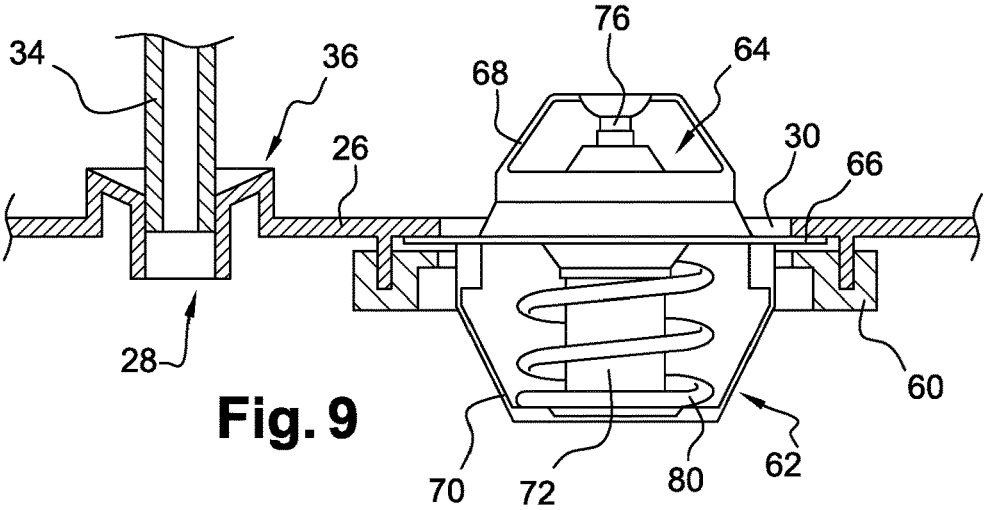
FIG. 9 is an axial section schematic view of a plate bearing an alternative embodiment of the shut-off system having a thermostatic element.
Figure 10:
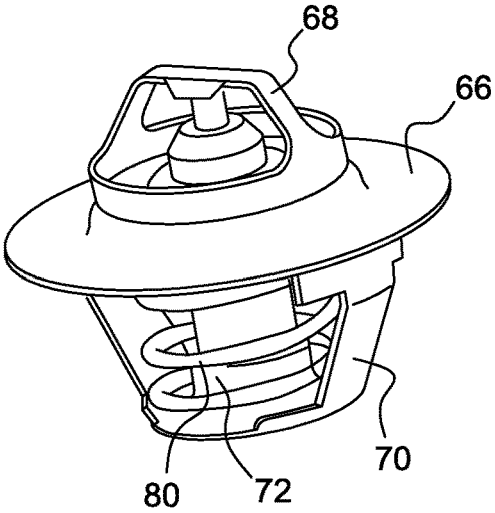
FIG. 10 is a perspective schematic view of the shut-off system of FIG. 9.
Figure 11:
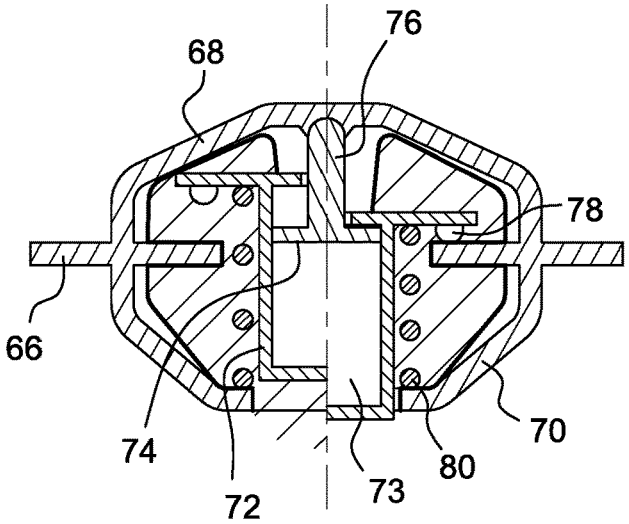
FIG. 11 is an axial section schematic view of the shut-off system of FIG. 9 and shows two positions.

In the case of FIGS. 9 to 11, the shut-off system comprises a thermostatic element. The pieces of this system or of the adjacent zone, which have been described above, are designated by the same references. This is the case of the plate 26 and of the duct 34 in particular.

The shut-off system is mounted in the hole 30 and fixed in the latter by means of a crimped, clipped or welded peripheral ring 60. The shut-off system bears a fixed external body 62 containing a movable internal body 64. The fixed body comprises a peripheral ring 66 inserted between the ring 60 and the plate 26, and two clamps, upper 68 and lower 70, respectively. The movable body 64 is mounted between the clamps 68, 70 and comprises a lower cylinder 72 including an internal cavity 73 for receiving a heat-sensitive wax and a piston disc 74, the shaft 76 of which bears upon the upper clamp 68. A sealing element, of O-ring 78 type, is fixed on this lower cylinder 72. The piston is fixed with respect to the upper clamp and the body, and the cylinder 72 can move axially, from the top to the bottom, from a high position shown on the left in FIG. 11, wherein liquid can circulate through the hole 30 by passing through the clamps 68, 70, as far as a low position shown on the right in the same figure, wherein the O-ring 78 is squeezed between a peripheral rim of the cylinder 72 and the peripheral edge of the hole 30. A compression spring 80 urges the cylinder into the high position thereof, which is therefore the position by default thereof. It is therefore understood that, by default, the shut-off system is open and allows the liquid to pass between the compartments of the reservoir. In operation, once the liquid has reached an operating predetermined temperature, the wax is heated and expands, which causes the cylinder to move and the shut-off system to close. The wax is chosen according to the required closing temperature of the reservoir.

Figure 12:
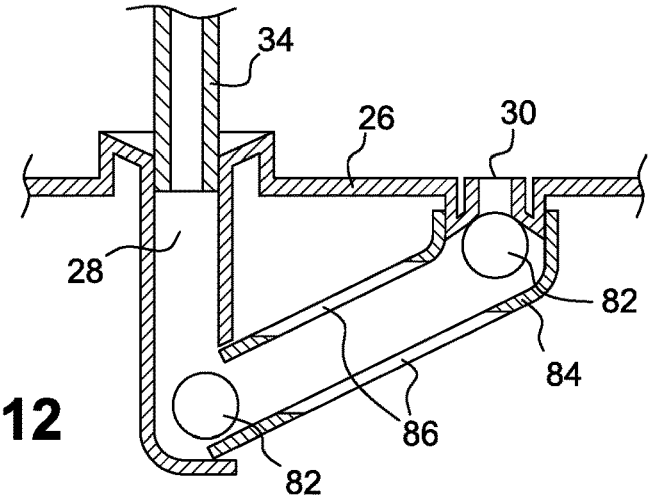
FIG. 12 is a sectional schematic view of another alternative embodiment of the shut-off system having a linear shutter.

In the case of FIG. 12, the shut-off system comprises a linear movement shutter, which is in the form of a ball 82. The ball 82 is configured to be moved by the flow of liquid. The ball 82 is trapped in a bent tube 84, the two ends of which are connected to the openings 28, 30, respectively. The ball can move from a low position, shown on the left in the drawing, as far as a high position, shown on the right in the drawing, and wherein the ball bears in a sealed manner on a seat, of complimentary shape, of the hole 30. The through-slots 86 of the tube 84 then allow the fluid to flow from the inlet (tube 34) toward the outlet hole 24. It is therefore understood that the low position of the ball is the default position, in the absence of liquid flow, and wherein the shut-off system is open and allows the liquid to pass between the compartments of the reservoir. In operation, once the liquid reaches the ball, it moves it as far as the high position which makes it possible to isolate the compartments from one another.

The invention claimed is:

1. Multi-compartment liquid reservoir (10) for a motor vehicle, comprising a first fluid compartment (14) equipped with a fluid inlet (18) and with a fluid outlet (22), and a second fluid compartment (16) equipped with a fluid inlet (20) and with a fluid outlet (24), the reservoir comprising a liquid-filling neck (12) and the first fluid compartment and the second fluid compartment being in fluid communication via at least one passage (30) allowing one of the first fluid compartment or the second fluid compartment to be filled via the other of the first fluid compartment or the second fluid compartment, the reservoir further comprising at least one shut-off system (44), able to move between a first position of opening of the at least one passage and a second position of closure of the at least one passage, wherein the shut-off system is configured to adopt the first position by default and in a free state, and to be urged into the second position, when the reservoir is in operation, by flow of a fluid that is circulating from the inlet to the outlet of one of the first fluid compartment or the second fluid compartment or when a fluid operating temperature is reached.

2. Reservoir (10) according to claim 1, in which the shut-off system comprises at least one shutter (44).

3. Reservoir (10) according to claim 2, in which the shutter (44) is able to move by pivoting or linearly between the first position and the second position.

4. Reservoir (10) according to claim 1, in which the shut-off system comprises at least one thermostatic element.

5. Reservoir (10) according to claim 1, in which the first fluid compartment and the second fluid compartment (14, 16) communicate with one another by at least one venting and expansion tube (38), a lower end of which is connected to the first fluid compartment and an upper end of which is situated in the second fluid compartment and above a maximum level for liquid in the first fluid compartment (14).

6. Reservoir (10) according to claim 5, in which the second fluid compartment (16) is separated from the first fluid compartment (14) by at least one insulating space and/or by at least one insulating plate (26).

7. Reservoir (10) according to claim 6, in which the insulating space is a peripheral insulating space extending over at least one side of the second fluid compartment (16).

8. Reservoir (10) according to claim 6, in which the insulating plate (26) comprises either a static layer of air or a honeycomb cell structure to limit the velocity of the fluid at its surface.

9. Reservoir (10) according to claim 8, in which the insulating plate (26) bears the at least one venting tube (38).

10. Reservoir (10) according to claim 1, in which the shut-off system (44) is situated inside the second fluid compartment (16).

11. Reservoir (10) according to claim 10, in which the second fluid compartment (16) comprises limit stops (56) defining the first and second positions.

12. Reservoir (10) according to claim 10, in which the second fluid compartment (16) is situated below a minimum level for liquid in the first fluid compartment (14).

13. Reservoir (10) according to claim 1, in which the first and second fluid compartments (14, 16) form a one-piece assembly.

14. Multi-compartment liquid reservoir (10) for a motor vehicle, comprising a first fluid compartment (14) equipped with a fluid inlet (18) and with a fluid outlet (22), and a second fluid compartment (16) equipped with a fluid inlet (20) and with a fluid outlet (24), the reservoir comprising a liquid-filling neck (12) and the first fluid compartment and the second fluid compartment being in fluid communication via at least one passage (30) allowing one of the first fluid compartment or the second fluid compartment to be filled via the other of the first fluid compartment or the second fluid compartment, the reservoir further comprising at least one shut-off system (44), able to move between a first position of opening of the at least one passage and a second position of closure of the at least one passage, wherein the shut-off system is configured to adopt the first position by default and in a free state, and to be urged into the second position, when the reservoir is in operation, when an operating temperature of the fluid is reached, wherein the shut-off system comprises at least one thermostatic element.

15. Multi-compartment liquid reservoir (10) for a motor vehicle, comprising a first fluid compartment (14) equipped with a fluid inlet (18) and with a fluid outlet (22), and a second fluid compartment (16) equipped with a fluid inlet (20) and with a fluid outlet (24), the reservoir comprising a liquid-filling neck (12) and the first fluid compartment and the second fluid compartment being in fluid communication via at least one passage (30) allowing one of the first fluid compartment or the second fluid compartment to be filled via the other of the first fluid compartment or the second fluid compartment, the reservoir further comprising at least one shut-off system (44), able to move between a first position of opening of the at least one passage and a second position of closure of the at least one passage, wherein the shut-off system is configured to adopt the first position by default and in a free state, and to be urged into the second position, when the reservoir is in operation, when a fluid is circulating from the inlet to the outlet of one of the first fluid compartment or the second fluid compartment, wherein the first fluid compartment and the second fluid compartment (14, 16) communicate with one another by at least one venting and expansion tube (38), a lower end of which is connected to the first fluid compartment and an upper end of which is situated in the second fluid compartment and above a maximum level for liquid in the first fluid compartment (14).

* * * * *